US005986626A

United States Patent [19]

Tanaka

[11] Patent Number: 5,986,626

[45] Date of Patent: Nov. 16, 1999

[54] FIELD EMISSION TYPE IMAGE DISPLAY PANEL AND METHOD OF DRIVING THE SAME

[75] Inventor: Mitsuru Tanaka, Mobara, Japan

[73] Assignee: Futaba Denshi Kogyo K.K., Mobara, Japan

[21] Appl. No.: 08/899,170

[22] Filed: Jul. 23, 1997

[30] Foreign Application Priority Data

Jul. 23, 1996 [JP] Japan ..... 8-210499

[51] Int. Cl.[6] ..... G09G 3/22

[52] U.S. Cl. ..... 345/74; 313/495

[58] Field of Search ..... 345/74, 75, 88, 345/103, 152, 43; 347/123; 315/349; 313/495

[56] References Cited

U.S. PATENT DOCUMENTS

| | | | |
|---|---|---|---|
| 5,162,704 | 11/1992 | Kobori et al. | 315/349 |
| 5,703,610 | 12/1997 | Kishino et al. | 345/74 |
| 5,703,611 | 12/1997 | Kishino et al. | 345/74 |
| 5,721,561 | 2/1998 | Kishino et al. | 345/75 |
| 5,754,148 | 5/1998 | Kishino et al. | 345/74 |
| 5,754,149 | 5/1998 | Browning et al. | 345/75 |
| 5,760,810 | 6/1998 | Onodaka | 347/123 |

FOREIGN PATENT DOCUMENTS 8-298075 11/1996 Japan .

*Primary Examiner*—Matthew Luu
*Assistant Examiner*—Jeff Piziali
*Attorney, Agent, or Firm*—Oblon, Spivak, McClelland, Maier & Neustadt, P.C.

[57] ABSTRACT

In a field emission type image display panel, plural cathode electrodes are formed in a stripe shape on a first substrate and each having emitters for field emission. Cathode lead-out electrodes supply signals to the cathode electrodes. Plural patch-like gate electrodes are arranged in a matrix form over the plural cathode electrodes and insulated from the plural cathode electrodes. Gate lead-out electrodes are led out along spaces between adjacent two rows in rows formed of patch-like gate electrodes substantially perpendicular to the cathode electrodes, each of the gate lead-out electrodes being connected to the patch-like gate electrodes in adjacent two rows in a zigzag arrangement and every other gate electrode. A second substrate is spaced from the first substrate a predetermined distance apart. Plural patch-like anode electrodes are arranged on the second substrate, the plural anode electrodes respectively confronting the plural patch-like gate electrodes in a matrix form. Fluorescent materials are formed over the plural patch-like anode electrodes, for displaying an image. Anode electrodes are led out along spaces between adjacent two rows of anode electrodes substantially perpendicular to the cathode electrodes, each of the anode lead-out electrodes being connected to anode electrodes in adjacent two rows in a zigzag arrangement and every other anode electrode.

9 Claims, 13 Drawing Sheets

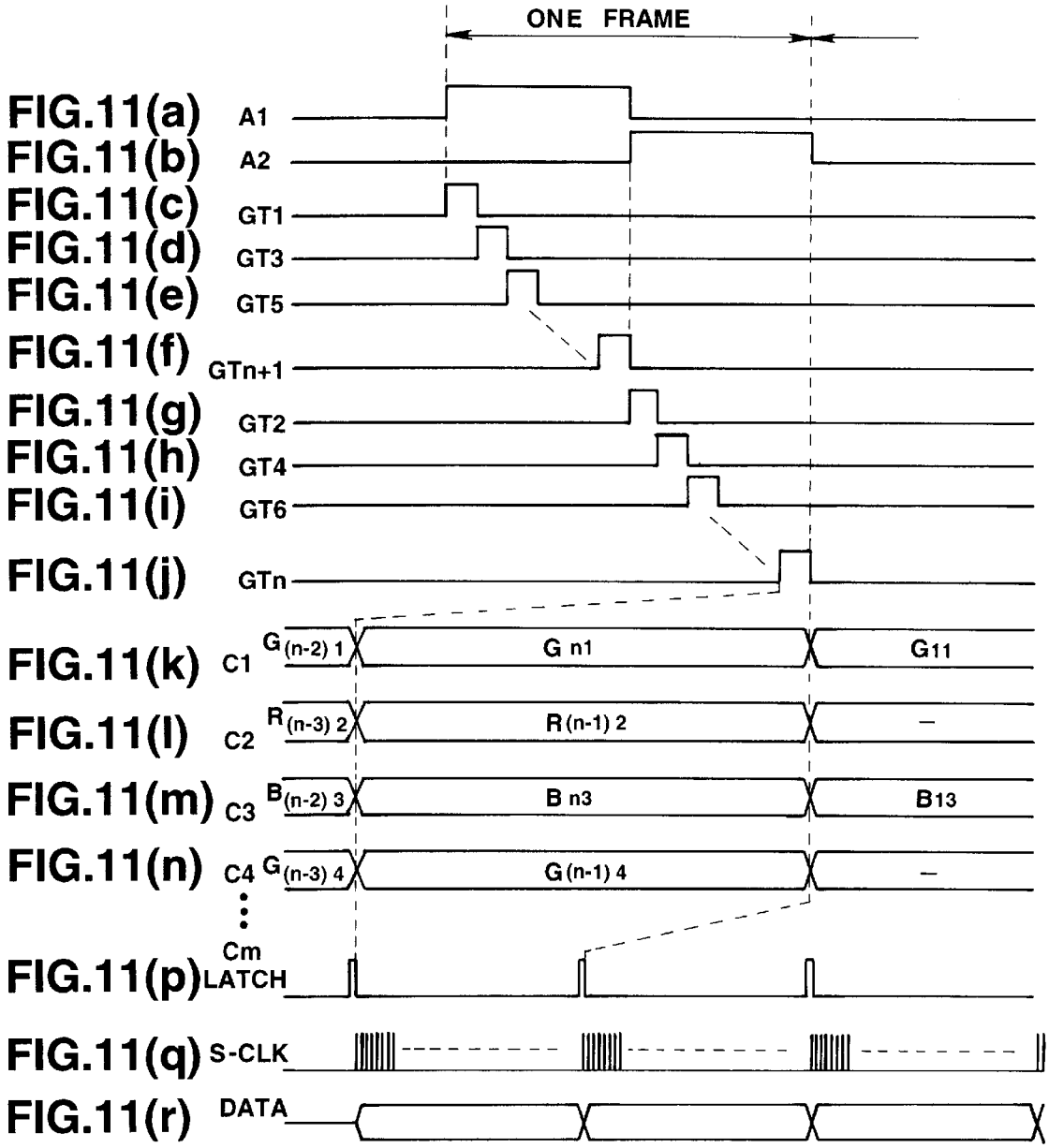
ONE FRAME
FIG.11(a) A1
FIG.11(b) A2
FIG.11(c) GT1
FIG.11(d) GT3
FIG.11(e) GT5
FIG.11(f) GTn+1
FIG.11(g) GT2
FIG.11(h) GT4
FIG.11(i) GT6
FIG.11(j) GTn
FIG.11(k) C1 G(n-2) 1 G n1 G11
FIG.11(l) C2 R(n-3) 2 R(n-1) 2 –
FIG.11(m) C3 B(n-2) 3 B n3 B13
FIG.11(n) C4 G(n-3) 4 G(n-1) 4 –
Cm
FIG.11(p) LATCH
FIG.11(q) S-CLK
FIG.11(r) DATA FIG.12(a) ANODE A1 GATE GT1
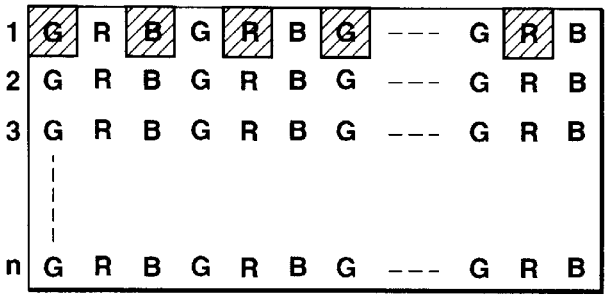
FIG.12(b) ANODE A1 GATE GT3
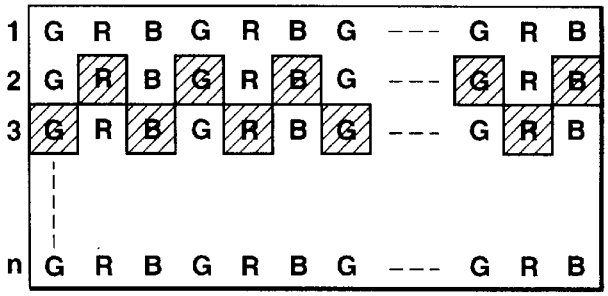
FIG.12(c) ANODE A1 GATE GTn+1
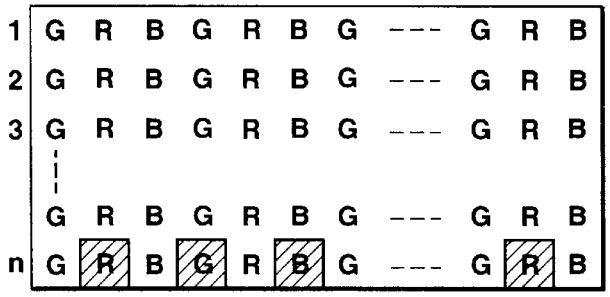
FIG.12(d) ANODE A2 GATE GT2
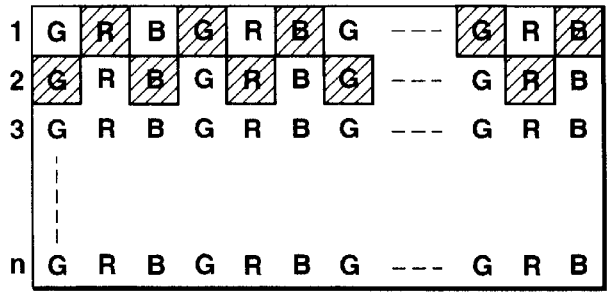
FIG.12(e) ANODE A2 GATE GTn
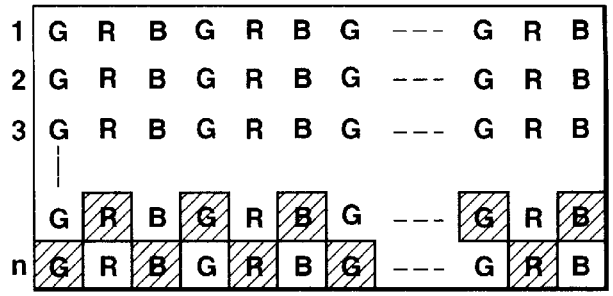

FIELD EMISSION TYPE IMAGE DISPLAY PANEL AND METHOD OF DRIVING THE SAME

BACKGROUND OF THE INVENTION (1) Field of the Invention

This invention relates to a field emission type image display panel and a method of driving the same.

(2) Description of the Related Art

When the electric field at a surface of a metal or semiconductor is as large as $10^9$ V/m, electrons pass through the potential barrier because of the tunnel effect, thus emitting out in a vacuum at room temperatures. This phenomenon is called field emission. The cathode emitting electrons utilizing the principle is referred to as a field emission type cathode.

Recently, flat emission type field emission cathodes each formed of an array of micron-size field emission type cathodes (hereinafter, referred to as FEC) have been able to be manufactured fully using semiconductor machining technology.

The structure of a field emission cathode called a Spindt type cathode is schematically shown in FIGS. 13(*a*) and 13(*b*).

FIG. 13(*a*) is a perspective view showing a FEC fabricated using the semiconductor micromachining technology. FIG. 13(*b*) is a cross-sectional view showing the FEC, taken along the line A—A in FIG. 13(*a*).

Referring to FIGS. 13(*a*) and 13(*b*), a cathode electrode 102 is formed on the substrate 101 by using vapor deposition. Cone emitters 105 are formed on the cathode electrode 102. Gate electrodes 104 are formed over the cathode electrode 102 where the cone emitters 105 are not formed, via the insulating layer 103 of silicon dioxide ($SiO_2$). The cone emitters 105 are respectively positioned in the round holes formed in the gate electrode 104 and the insulating layer 103.

That is, the tip of each cone emitter 105 is viewed in the hole opened in the gate electrode 104.

The cone emitters 105 are fabricated at pitch intervals of less than 10 microns, using micromachining technology. Thus, several ten to several 100 thousands of FECs can be fabricated on a single substrate 101.

Since the distance between the gate electrode 104 and the tip of the emitter 105 can be set in the order of submicrons, the emitter 105 can emit electrons caused by the field emission when a small voltage of several tens of volts is applied between the gate electrode 104 and the cathode electrode 102.

The above-mentioned FEC can be made as a flat field emission cathode. It has been proposed to apply the flat field emission cathode to a flat color display panel. The cross-section of the color image display panel is partially shown in FIG. 14.

In FIG. 14, columns of cathode electrodes 102 are arranged in a stripe from on the first substrate 101 of glass. Stripe-like gate electrodes 104 are arranged perpendicularly to the columns of the stripe-like cathode electrodes 102. The cone emitters 105 are arranged on the cathode electrodes 102 at the intersections.

The tips of the emitters 105 located at each of the intersections where the columns of the gate electrodes 104 intersects the columns of the cathode electrodes 102 point upward. The insulating layer 103 isolates the cathode electrodes 102 from the gate electrodes 104. Holes are formed in the insulating layer 103 to emit electrons.

The second substrate 110 of glass is arranged so as to confront the first substrate 101. A sheet of anode electrode 111 is formed on the nearly whole surface of the second substrate. Red fluorescent material 112, green fluorescent material 113, and blue fluorescent material 114 in stripe form are formed on the anode electrode 111 so as to confront the stripes of the cathode electrodes 102 respectively.

In order to display color images on the color display panel, the gate electrodes 104 are sequentially scanned and driven one by one while R, G, and B image data corresponding to one selected line of the gate electrode 104 are supplied to the cathode electrodes 102. Then, when all the gate electrodes 104 are sequentially scanned and selectively driven, a full color image for one frame is displayed on the second substrate 110.

However, in the color image display panel, it has been assumed that electrons emitted from the emitter 105 formed on the cathode electrode 102 reach the anode electrode 111, with a divergent angle of about 30°. Hence, the problem is that electrons which reach the anode electrode 111 with a divergence of a considerable degree may glow a different color fluorescent material adjacent to the anode electrode 111. As a result, the color image displayed is blurred.

In order to solve the above-mentioned problem, the present applicant proposed a field emission type image display panel that can display color images with no blurring, by focusing electrons emitted from the emitter 105 (refer to the Japanese Patent Application (Tokugan-Hei) No. 7-114134).

FIG. 15 is a top view partially illustrating a field emission type image display panel proposed above.

In the field emission type image display panel of FIG. 15, stripe-like cathode electrodes 102 shown with chain lines are arranged on the first glass substrate (not shown). The cathode lead-out electrodes C1, C2, . . . , C*m* are respectively connected to the stripe-like cathode electrodes 102.

Patch-like gate electrodes 120 are formed over the cathode electrodes 102 through an insulating layer (not shown) while they are arranged corresponding to respective pixels. As previously described, an emitter array is formed on the patch-like gate electrodes 120.

The second substrate (not shown) is arranged so as to confront the cathode electrodes 102. An anode electrode 111, shown with broken lines, is formed over the entire surface of the second substrate. R fluorescent, G fluorescent, and B fluorescent materials are formed on the anode electrode 111 so as to confront the respective patch-like gate electrodes 120. In FIG. 15, symbols associated with gate electrodes 120 represent colors emitted from the fluorescent material.

The patch-like gate electrodes 120 corresponding to G, B, and B pixels odd numbered in the (i) line (rows) are connected to the gate lead-out electrode GT*i*−1. The gate electrodes 120 corresponding to remaining R, G, and B pixels even numbered in the (i) line are connected to the gate lead-out electrode GT*i*.

Furthermore, the patch-like gate electrodes 120 corresponding to G, B, and R pixels odd-numbered of the (i+1) line is connected to the gate lead-out electrode GT*i*. The patch-like gate electrodes 120 corresponding to remaining R, G, and B pixels even-numbered of the (*i*−1) line is connected to the gate lead-out electrode GT*i*−1 (not shown). In a similar manner, in the gate lead-out electrodes GT1 to GT*n*, the patch-like gate electrodes 120 of an upper line (row) as well as the patch-like gate electrodes 120 of a lower line (row) are connected to each gate lead-out electrode in a zigzag pattern and every other gate electrode.

The gate lead-out electrodes GT1 to GT*n* are sequentially scanned and driven. For example, when the gate lead-out electrode GT*i* is scanned, the R, G, and B pixels even-numbered of the (i) line (hatched) and the G, B, and R pixels odd-numbered of the (*i*+1) line are driven.

When image data are correspondingly input to the cathode electrodes C1, C2, . . . , C*m* respectively confronting the patch-like gate electrodes 120, an image can be displayed on the anode substrate. When the gate lead-out electrodes GT*i*−1 and GT*i*+1 not driven are set to a low level potential, preferably to the ground level, the adjacent patch-like gate electrodes 120 on the sides of each of the patch-like gate electrodes 120 (hatched) are driven to a low level potential. This allows electron beams emitted from the patch-like gate electrodes 120 driven to be focused.

As described above, in the field emission type image display panel using patch-like gate electrodes, electron beams emitted from the emitters 105 can be focused. However, in recent years, there have been strong demands for high brightness, high resolution, field emission type image display panels. It is required to more focus electrons emitted from the emitter 105.

SUMMARY OF THE INVENTION

It is an object of the invention is to provide a field emission type image display panel that can display images with high brightness and high resolution by more focusing field-emitted electrons.

Another object of the present invention is to provide a method of driving a field emission type display panel.

In order to accomplish the above-mentioned objects, a field emission type display device comprises a field emission type image display panel, plural cathode electrodes formed in a stripe shape on a first substrate and each having emitters for field emission; cathode lead-out electrodes for supplying signals to the cathode electrodes; plural patch-like gate electrodes arranged in a matrix form over the plural cathode electrodes and insulated from the plural cathode electrodes; gate lead-out electrodes which are led out along spaces between adjacent two rows in rows formed of patch-like gate electrodes substantially perpendicular to the cathode electrodes, each of the gate lead-out electrodes being connected to the patch-like gate electrodes in adjacent two rows in a zigzag arrangement and every other gate electrode; a second substrate spaced from the first substrate a predetermined distance apart; plural patch-like anode electrodes arranged on the second substrate, the plural anode electrodes respectively confronting the plural patch-like gate electrodes in a matrix form; fluorescent materials formed over the plural patch-like anode electrodes, for displaying an image; and anode lead-out electrodes which are led out along spaces between adjacent two rows of anode electrodes substantially perpendicular to the cathode electrodes, each of the anode lead-out electrodes being connected to anode electrodes in adjacent two rows in a zigzag arrangement and every other anode electrode.

Each of the plural anode lead-out electrodes comprises a multi-layered structure of metal films.

Moreover, according to the present invention, a driving method of a field emission type image display panel which includes plural cathode electrodes formed in a stripe shape on a first substrate and each having emitters for field emission; cathode lead-out electrodes for supplying signals to the cathode electrodes; plural patch-like gate electrodes arranged in a matrix form over the plural cathode electrodes and insulated from the plural cathode electrodes; gate lead-out electrodes which are led out along spaces between adjacent two rows in rows formed of patch-like gate electrodes substantially perpendicular to the cathode electrodes, each of the gate lead-out electrodes being connected to the patch-like gate electrodes in adjacent two rows in a zigzag arrangement and every other gate electrode; a second substrate spaced from the first substrate a predetermined distance apart; plural patch-like anode electrodes arranged on the second substrate, the plural anode electrodes respectively confronting the plural patch-like gate electrodes in a matrix form; fluorescent materials formed over the plural patch-like anode electrodes, for displaying an image; and anode lead-out electrodes which are led out along spaces between adjacent two rows of anode electrodes substantially perpendicular to said cathode electrodes, each of the anode lead-out electrodes being connected to anode electrodes in adjacent two rows in a zigzag arrangement and every other anode electrode, the method comprises the steps of selectively driving the gate lead-out electrodes every other gate electrode; setting a gate lead-out electrode not selectively driven to a low level potential such that patch-like gate electrodes adjacent to and on both sides of a patch-like gate electrode selectively driven are set to a low level potential; and setting a patch-like anode electrode which confronts the patch-like gate electrode not selectively driven to a low level potential; wherein electrons emitted from the emitter are focused.

The field emission type image display panel driving method further comprises the step of setting both the patch-like gate electrode not selectively driven and the patch-like anode electrode to a negative potential level.

According to the field emission type image display panel of the present invention, the gate electrodes and anode electrodes are shaped in a patch form. Moreover, since patch-like gate electrodes and anode electrodes not selectively driven are driven to and scanned at a low level potential, emitted electrodes can be focused in a preferred condition, so that images with no blur can be obtained.

The above and other objects, features and advantages of the present invention will become apparent from the following description when taken in conjunction with the accompanying drawings which illustrate preferred embodiments of the present invention by way of example.

BRIEF DESCRIPTION OF THE DRAWINGS

FIG. 11 is a timing chart in the driving method of the present invention;

FIG. 12 is a diagram showing pixel selection conditions according to the driving method of the present invention;

DETAILED DESCRIPTION OF THE PREFERRED EMBODIMENTS

The embodiments according to the present invention will now be described below with reference to the attached drawings.

Figure 1:
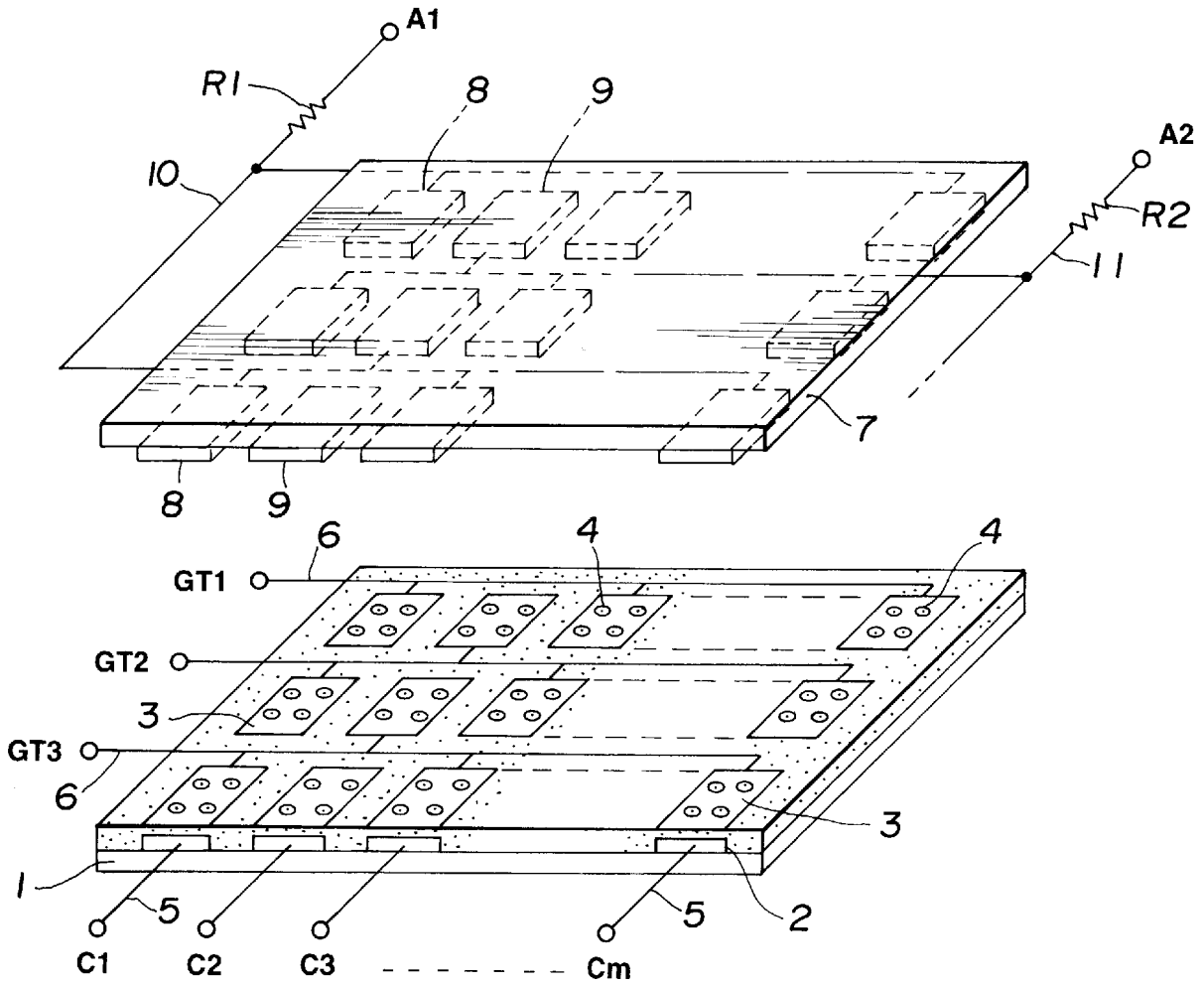
FIG. 1 is a perspective view showing a field emission type image display panel according to the present invention.

FIG. 1 is a perspective view showing the configuration of a field emission type image display panel according to an embodiment of the present invention.

Referring now to FIG. 1, numeral 1 represents a cathode substrate such as glass on which a field emission cathode (FEC) array is formed. Numeral 2 represents each of plural stripe-like cathode electrodes formed on the cathode substrate 1. Numeral 3 represents each of plural patch-like gate electrodes respectively formed over the cathode electrodes 2 through an insulating layer. Numeral 4 represents a hole formed in the gate electrode 3 to path through electrons. Cone emitters are arranged on the cathode electrode inside the hole 4.

Moreover, numeral 5 represents cathode lead-out electrodes (C1 to C*m*) respectively derived from the cathodes 2. Numeral 6 represents gate lead-out electrodes GT1, GT2, GT3, . . . , GT*n*+1 (where n is even number) each to which the patch-like gate electrodes 3 of an upper line (row) as well as the patch-like gate electrodes 3 of a lower line (row) are connected in a zigzag pattern. Numeral 7 represents an anode substrate which confronts the cathode substrate 1 and on which anode electrodes 8 and 9 are formed. Numerals 8 and 9 represent plural patch-like anode electrodes formed on the anode substrate 7. As depicted in FIG. 1, the anodes 8 and 9 are arranged so as to be adjacent to each other. Numeral 10 represents an anode lead-out electrode connected to the anode electrodes 8. Numeral 11 represents an anode lead-out electrode A2 connected to the anode electrodes 9. The anode lead-out electrode A1 is connected to a resistor R1 to prevent anode-to-gate electric discharging. The anode lead-out electrode A2 is connected to a resistor R2 to prevent anode-to-gate electric discharging. The resistors R1 and R2 may be removed and cause of no adverse effect in operation.

The patch-like anode electrodes 8 and 9 and the patch-like gate electrode 3 are arranged so as to confront each other. R, G, and B fluorescent materials (not shown) formed on the patch-like anode electrodes 8 and 9 are arranged periodically.

The method of driving the image display panel will be described in detail later. Here, the driving method will be briefly described as an example. Every other one of gate lead-out electrodes GT1 to GT*n*+1 are scanned so that the patch-like gate electrodes 3 of an upper line (row) as well as the patch-like gate electrodes 3 of a lower line (row) are driven in a zigzag pattern. At this time, the patch-like anode electrodes 8 or 9 respectively confronting the patch-like gate electrodes 3 driven are driven. In other words, the anode lead-out electrode A1 or A2 is selected to apply an anode voltage. The corresponding image data are respectively input to the cathode lead-out electrodes C1 to C*m*.

That is, first, gate lead-out electrodes GT1, GT3, . . . , GT*n*+1, odd-numbered, are sequentially scanned. At this time, a positive anode voltage is applied to the anode lead-out electrode A1 while image data for display pixels are input to the cathode lead-out electrodes C1 to C*m* according to the scan timing. Thus, fluorescent pixels formed on the patch-like anode electrodes 8 are excited by electrons emitted from the cathode electrodes 2 selectively driven. The pixels controllably glow according to image data input to the cathode lead-out electrodes C1 to C*m*.

When the gate lead-out electrodes GT1, GT3, . . . , GT*n*+1 odd-numbered are scanned to the last one, a positive anode voltage is applied to the anode lead-out electrode A2, in place of the anode lead-out electrode A1. In such a state, the gate lead-out electrodes GT2, GT4, . . . , GT*n* even-numbered are sequentially scanned. Meanwhile, image data for image pixels are input to the cathode lead-out electrodes C1 to C*m* according to the scan timing. Thus, fluorescent pixels formed on the patch-like anode electrodes 9 can glow from electrons emitted from the cathode electrodes 3 arranged alternately and connected to the scanned gate lead-out electrodes GT2 to GT*n*. The glow control can be performed according to the image data input to the cathode electrodes 2, thus displaying an image for one frame.

Figure 2:
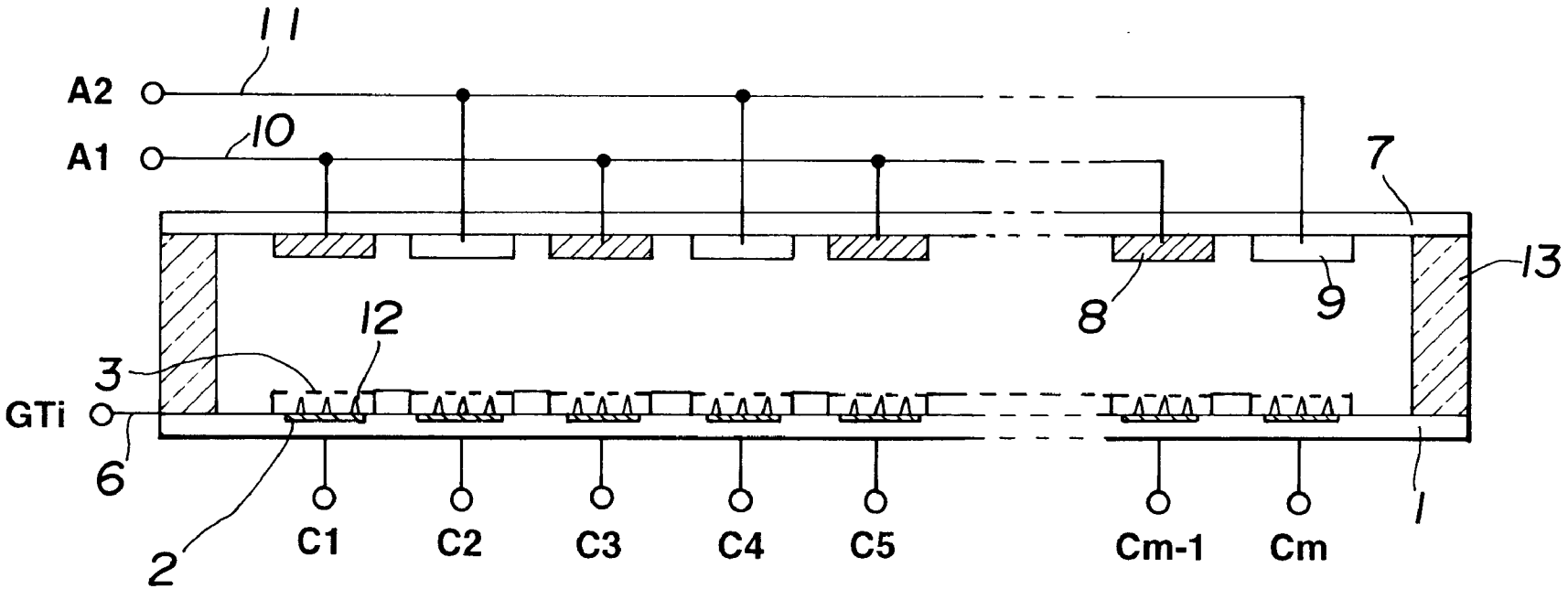
FIG. 2 is a cross-sectional view showing a field emission type image display panel according to the present invention.
Figure 3:
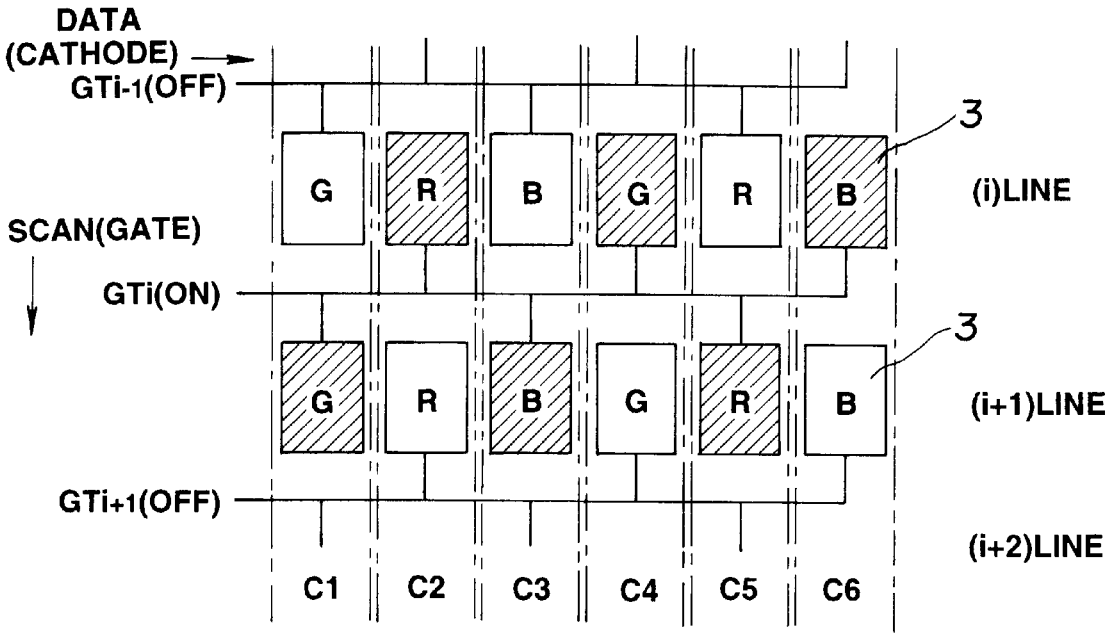
FIG. 3 is a diagram partially showing the relationship between patch-like gate electrodes and gate lead-out electrodes and cathode electrodes according to the present invention.
Figure 4:
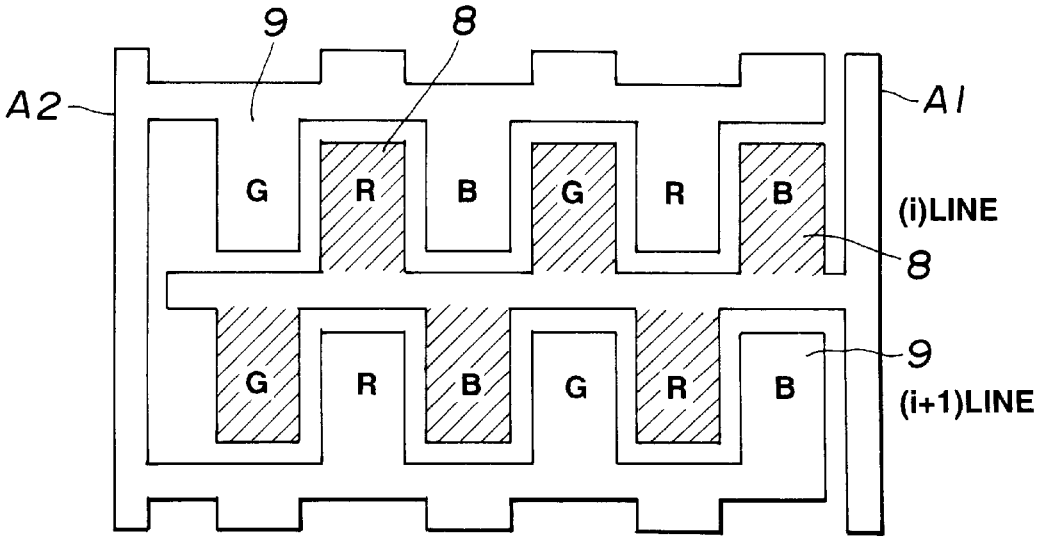
FIG. 4 is a diagram showing the relations hip between patch-like anode electrodes and anode lead-out electrodes according to the present invention.

FIG. 2 illustrates a cross-sectional view showing the image display panel shown in FIG. 1. FIG. 3 illustrates the relationship between patch-like gate electrodes 3 and gate lead-out electrodes GT1 to GT*n*. FIG. 4 illustrates the relationship between patch-like anode electrodes 8 and 9 anode lead-out electrodes A1 and A2.

Referring to FIG. 2, numeral 1 represents a cathode substrate. Numeral 2 represents stripe-like cathode electrodes formed on the cathode substrate 1. Numeral 3 represents patch-like gate electrodes formed over the cathode substrate 1 through an insulating layer (not shown) so as to be arranged in the row direction perpendicular to the cathode electrodes 2. Numeral 6 represents the i-th lead-out electrode GT*i* derived from the patch-like gate electrode 3. Numeral 7 represents an anode substrate on which patch-like anode electrodes are formed, arranged so as to confront the cathode substrate 1 or the first substrate. Numeral 8 represents a patch-like anode electrode formed between patch-like anode electrodes 9. Numeral 9 represents a patch-like anode electrode formed between patch-like anode electrodes 8. Numeral 10 represents an anode lead-out electrode A1 connected to the patch-like anode electrodes 8. Numeral 11 represents an anode lead-out electrode A2 connected to the patch-like anode electrodes 9.

Furthermore, numeral 12 represents an emitter array of cone emitters formed on the cathode electrode 2. Each cone emitter, formed using semiconductor micromachining technology, emits electrons by application of an electric field. Numeral 13 represents a spacer supporting the cathode substrate 1 and the anode substrate 7 with a predetermined gap. A container for an image display panel can be formed of the cathode substrate 1, the anode substrate 7, and the spacers 13. The inside of the container is evacuated to high vacuum.

FIG. 3 is a plan view partially illustrating the cathode substrate 1. As shown in FIG. 3, each of the patch-like gate electrodes 3 arranged in a row (line) corresponds to one pixel. Odd-numbered patch-like gate electrodes 3 corresponding to G, B, and R pixels in the (i) line row (line) are connected to the gate lead-out electrode GT*i*−1. The remaining even-numbered patch-like gate electrodes 3 corresponding to R, G, and B pixels in the (i) line are connected to the gate lead-out electrode GT*i*.

The odd-numbered patch-like gate electrodes 3 corresponding to G, B, and R pixels in the (i+1) line are connected to the gate lead-out electrode GT*i*.

The remaining even-numbered patch-like gate electrodes 3 corresponding to R, G, and B pixels in the (i−1) line (not shown) are connected to the gate lead-out electrode GT*i*−1. That is, the patch-like gate electrodes 3 of an upper row (line) as well as the patch-like gate electrodes 3 of a lower row (line) are connected to each of the gate lead-out electrodes GT1 to GT*n*, in a zigzag pattern and alternately.

FIG. 4 is a plan view partially illustrating the anode substrate 7. As shown in FIG. 4, like the gate electrodes 3, the patch-like anode electrodes 8 and 9 of each row (line) are divided to have rectangular areas acting as pixels. The odd numbered patch-like anode electrodes 9 corresponding to G, B, and R pixels of the (i) line (row) are connected to the anode lead-out electrode A2. The remaining even-numbered patch-like anode electrodes 8 corresponding to R, G, and B pixels of the (i) line are connected to the anode lead-out electrode A1.

Thetodd-numbered anode electrodes 8 corresponding to G, B, and R pixels of the (i+1) line are also connected to the anode lead-out electrode A1.

Moreover, the remaining even-numbered anode electrodes 9 corresponding to R, G, and B pixels of line (i+1) are also connected to the anode lead-out electrode A2. That is, the patch-like anode electrodes 8 of the upper and lower lines (rows) are connected to the anode lead-out electrode A1 in a zigzag pattern while the anode electrodes 9 of the upper and lower lines (rows) are connected to the anode lead-out electrode A2 in a zigzag pattern.

The gate lead-out electrodes GT1 to GT*n+1* are sequentially scanned and driven alternately. For example, when the gate lead-out electrode GT*i* is driven, an anode voltage is applied via the anode lead-out electrode A1 to the patch-like anode electrodes 8 formed on the anode substrate respectively confronting the patch-like gate electrodes 3 driven. In this operation, the R, G, and B pixels even-numbered of the (i) line as well as the G, B, and R pixels odd-numbered of the (i+1) line are driven.

An image can be displayed by inputting the corresponding image data to the cathode electrodes C1, C2, . . . , C*m* respectively confronting the patch-like gate electrodes 3 to be driven.

Figure 5:
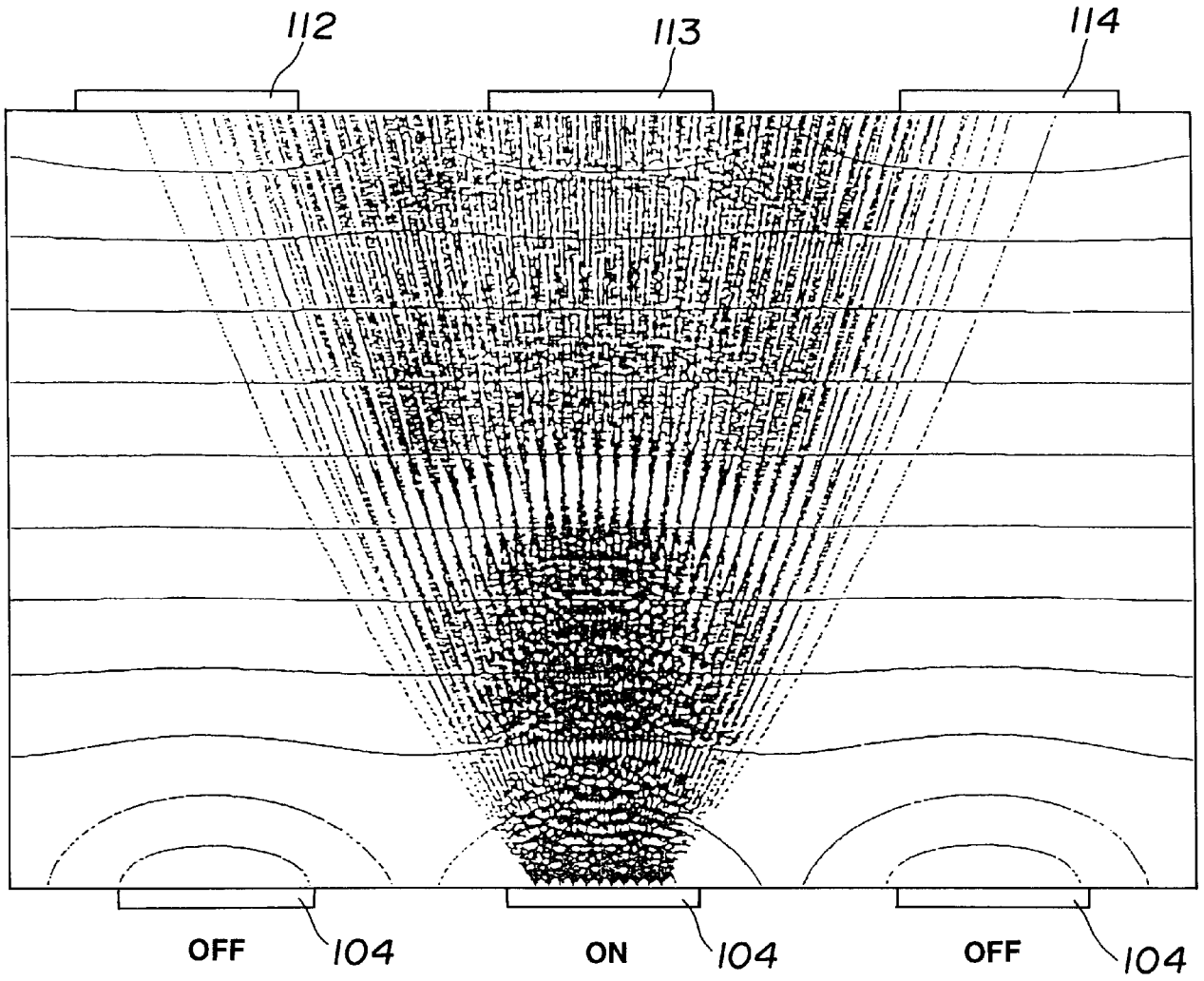
FIG. 5 is a diagram showing a locus distribution of electrons emitted from a cathode electrode.

FIG. 5 shows an example of a simulated locus distribution of emitted electrons reaching an anode electrode. This locus distribution simulation relates to a conventional field emission cathode on the condition that the anode electrodes 112, 113, and 114 are at the same potential and the gate electrode 104 is shaped in a stripe and all the gate electrodes of one line are at the same potential.

In this case, it is assumed that electrons are field-emitted from the emitter array with a diverse angle of about 30. In the locus of emitted electrons, electrons considerably spread out at the end of the gate electrode 104 and finally reach the anode electrode 113 and adjacent anode electrodes 112 and 114, thus causing a leakage of glowing.

Figure 6:
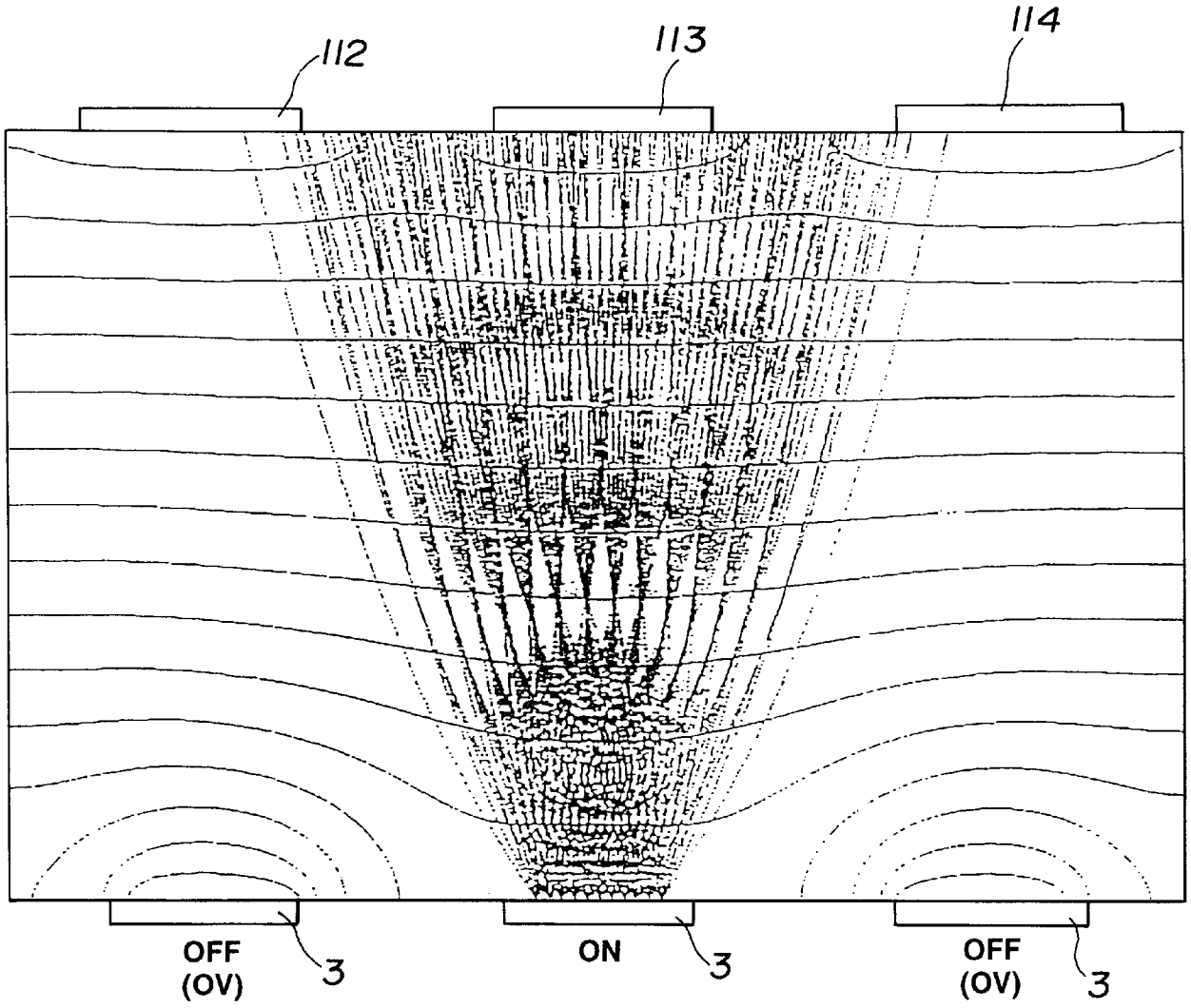
FIG. 6 is a diagram showing a locus distribution of electrons emitted from a cathode electrode when the potential of a gate electrode in an undriven state is at the ground level.

FIG. 6 shows an example of a simulation result of an emitted electron locus distribution on condition that the gate electrodes are in a patch shape and that adjacent patch-like gate electrodes 3 on both sides of the patch-like gate electrode 3 to which a drive voltage is being applied are at a ground level potential (off state) and that the anode electrodes 112, 113, and 114 are at the same potential. In this case, the diffusion of electrons are narrower than that shown in FIG. 5.

Figure 7:
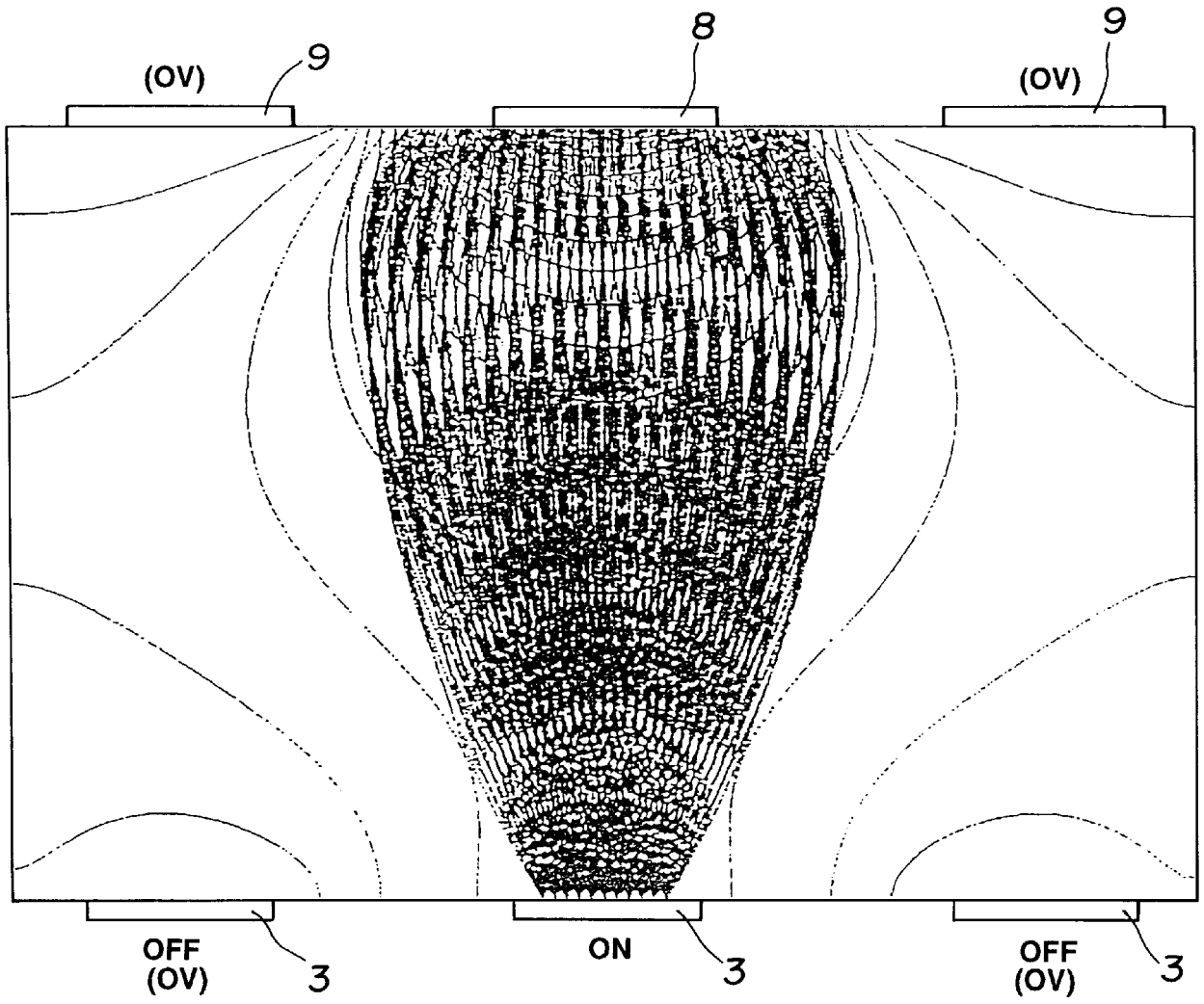
FIG. 7 is a block diagram showing a locus distribution of electrons emitted from a cathode electrode when the potentials of a gate electrode and an anode electrode in an undriven state are at the ground level.

FIG. 7 shows an example of a simulation result of an emitted electron locus distribution on condition that the anode electrodes are in a patch shape and that adjacent patch-like anode electrodes on both sides of the patch-like anode 8 to which an anode voltage is being applied (on) are at the ground level potential (off state) and that the gate electrodes are in a patch shape and that adjacent gate electrodes 3 on both sides of the patch-like gate electrode 3 to which a drive voltage is being applied (on) are at the ground level potential (off state). In this case, electrons are focused to be directed only to a target anode electrode 8.

As described above, the gate lead-out electrode GT*i*−1 and the gate lead-out electrode GT*i*+1 not driven are at the ground level potential while the patch-like gate electrodes 3 adjacent to the patch-like gate electrodes 3 (hatched) shown in FIG. 3 are at the ground level potential. The anode lead-out electrode A2 to which an anode voltage is not applied is at the ground level potential while the anode electrodes 9 adjacent to the anode electrodes 8 (hatched) shown in FIG. 4 are at the ground level potential.

In such conditions, electrons emitted via the gate electrode 3 can be further focused. In a high resolution, field emission type image display panel, a leakage of glowing can be prevented as much as possible, so that only a fluorescent material coated on a target anode electrode 8 can glow.

When a negative voltage is applied to the gate lead-out electrodes GT*i*−1 and GT*i*+1 not driven and the anode lead-out electrode A2 to which an anode voltage is not applied, electrons emitted from the emitter can be further focused.

Figure 8:
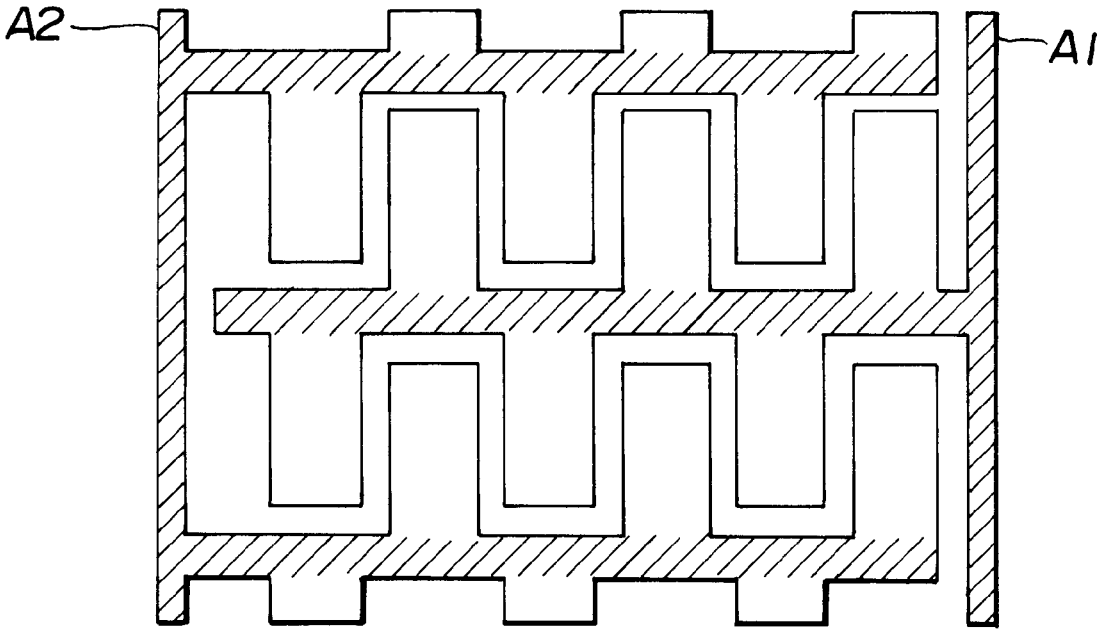
FIG. 8 is a diagram showing an example of wiring an anode lead-out electrode of multi-layered metal films.

The patch-like anode electrodes 8 and 9 and the anode lead-out electrodes A1 and A2 formed on the anode substrate 7 are fabricated using Indium Tin oxide (ITO) films. Since the ITO film has a large resistance value, the ITO film is laminated with a metal film, as shown with the hatched portions in FIG. 8, so that the resistance values of the anode lead-out electrodes A1 and A2 are lowered. This process can prevent a drop of an anode voltage in the anode lead-out electrodes A1 and A2, thus focusing electrons emitted via the gate electrode 3.

Figure 9:
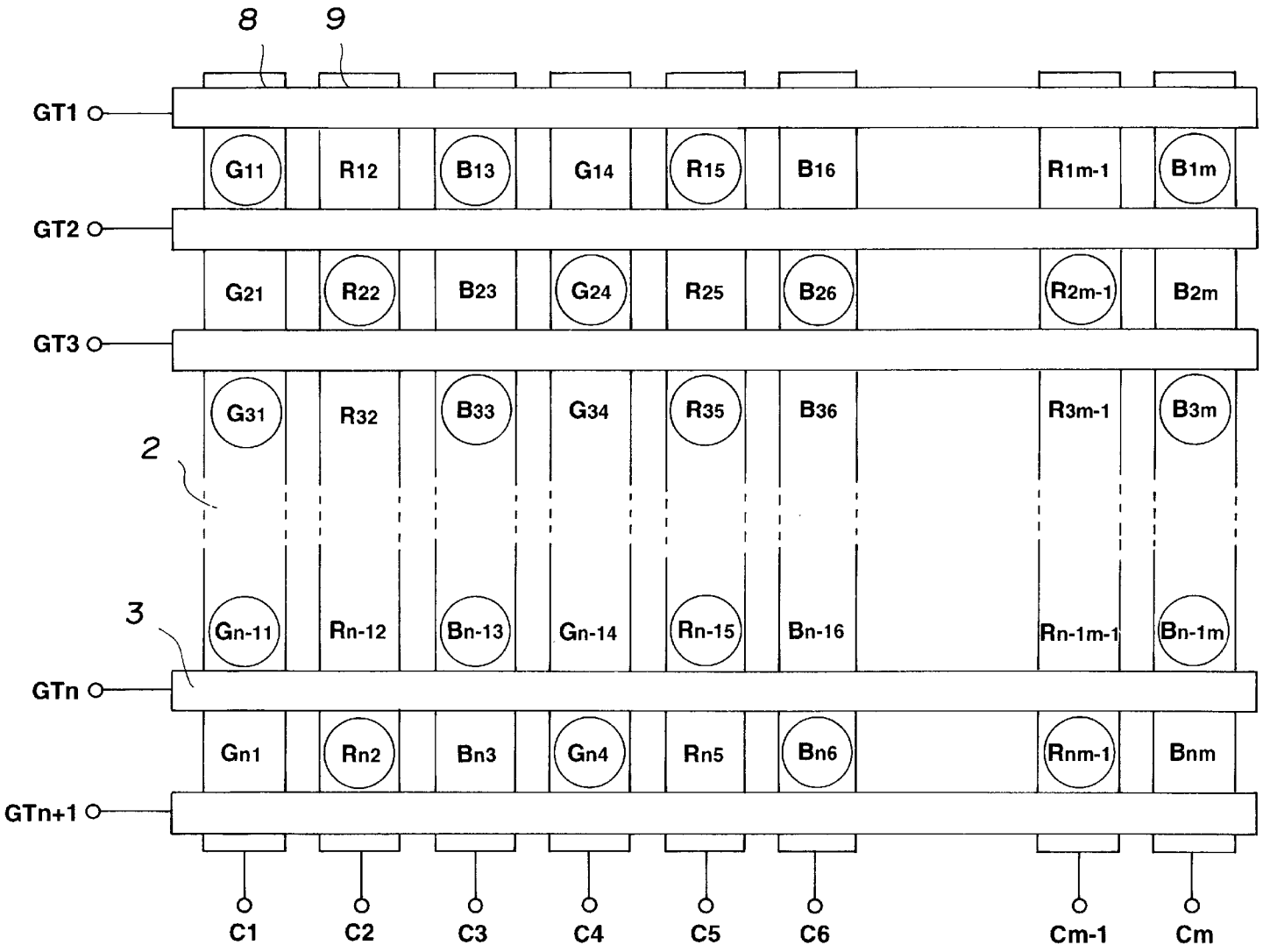
FIG. 9 is a diagram showing an example of the electrode layout in a field emission type image display panel according to the present invention.
Figure 10:
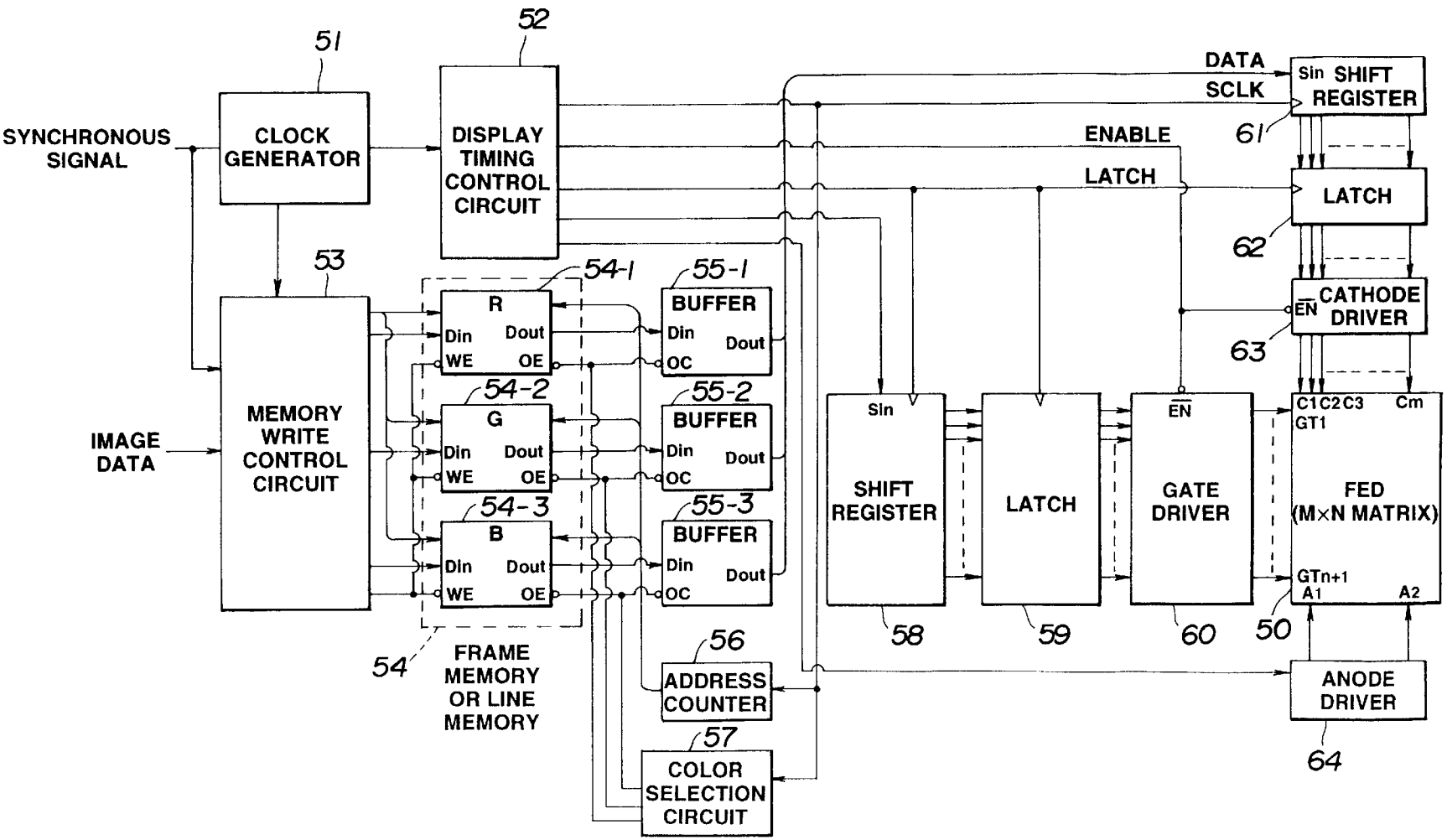
FIG. 10 is a block circuit diagram used for explaining the driving method according to the present invention.
Figure 13A:
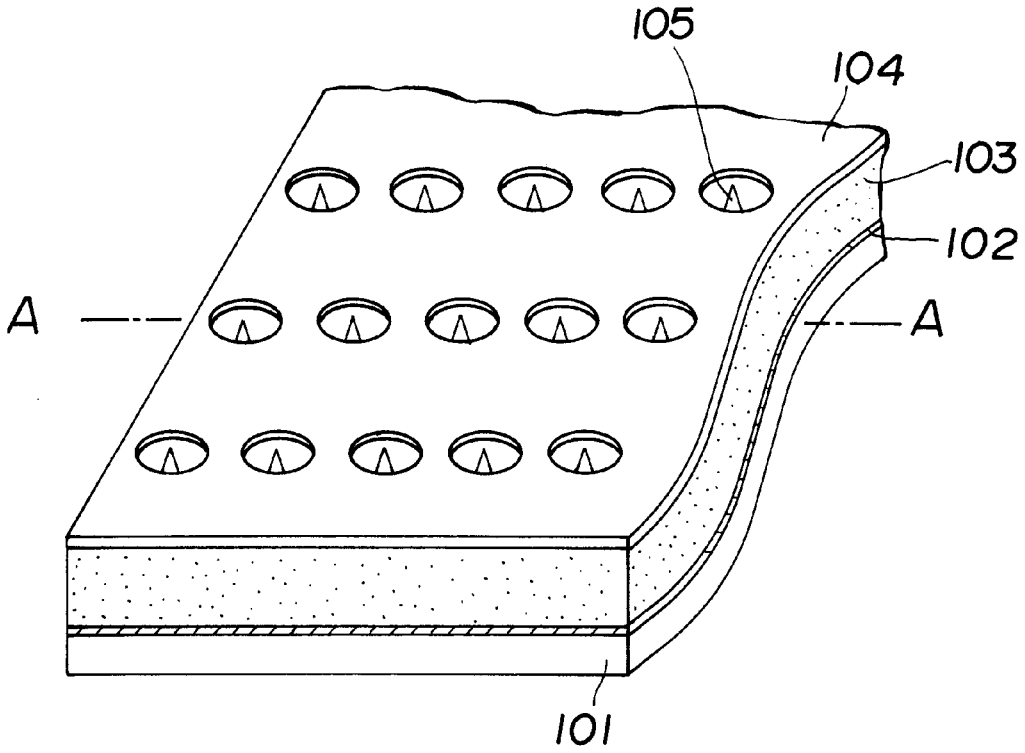
FIG. 13 is a diagram showing the configuration of a conventional field emission type cathode.
Figure 13B:
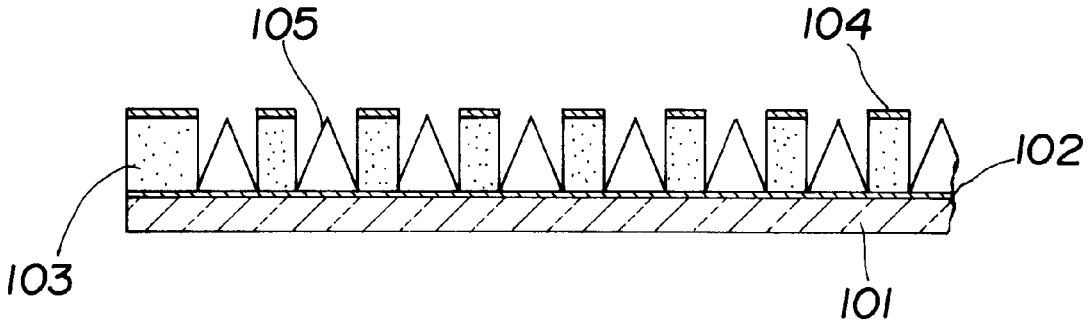
Figure 14:
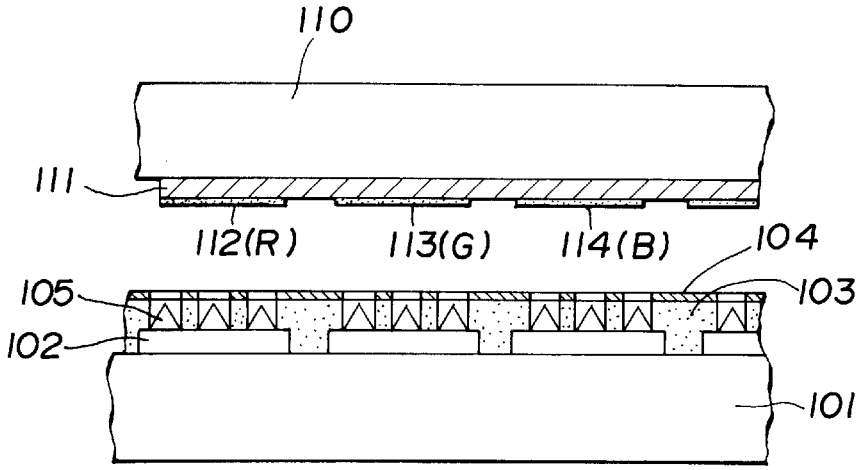
FIG. 14 is a cross-sectional view showing a conventional field emission type image display panel.
Figure 15:
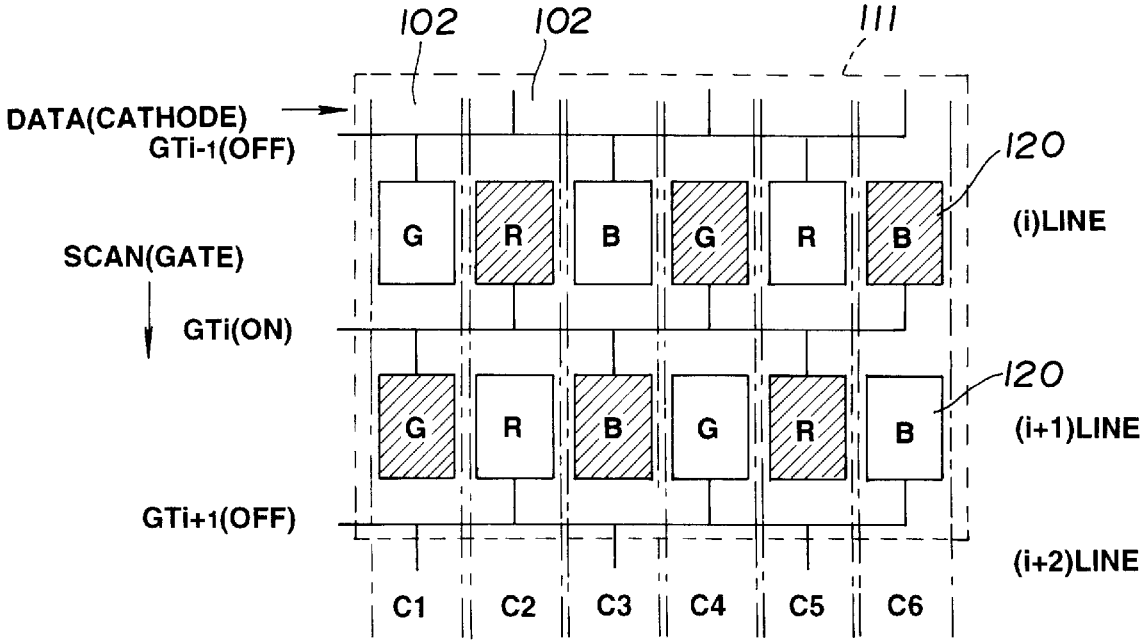
FIG. 15 is a top view partially showing a field emission type image display panel proposed by this applicant.

FIG. 10 is a block diagram showing the configuration of a drive circuit embodying the field emission type image display panel according to the present invention. The arrangement of electrodes viewed from the anode electrode in the image display panel is shown in FIG. 9.

Referring to FIG. 9, a field emission type image display panel is formed in an n×m matrix pattern (where n is an even number). The patch-like anode electrodes 8 (not shown) are connected to the anode lead-out electrode A1 (not shown). Patch-like anode electrodes 9 (not shown) are formed between the anode electrodes 8 to connect to the anode lead-out electrode A2 (not shown).

The cathode electrodes 2 are spaced from the anode electrodes 8 and 9 and respectively confront the anode electrodes 8 and 9. Cathode lead-out electrodes C1 to C*m* are respectively derived from stripe electrodes of the cathode electrodes 2.

The patch-like gate electrodes 3 are arranged over and perpendicularly to the cathode electrodes 2 via an insulating layer. The cathode lead-out electrode C1 is connected to the patch-like gate electrodes 3 odd-numbered of the first line. The gate lead-out electrode C2 is connected to the patch-like gate electrodes 3 even-numbered of the first line and the patch-like gate electrodes 3 odd-numbered of the second line. In a similar manner, the patch-like gate electrodes 3 associated with upper and lower lines (rows) are connected to a gate lead-out electrode in a zigzag pattern. The patch-like gate electrodes odd-numbered of the n-th line are connected to the last gate lead-out electrode GT*n*+1. An electron emitting hole (not shown) through which electrons pass is formed in each of the gate electrodes 3.

G, R, and B fluorescent materials are coated on the anode electrodes 8 and 9 so as to be arranged, for example, from right to left and in order, and so as to confront cathode electrodes 2 respectively. A pixel is formed at the portion where the patch-like gate electrode 3 intersects the cathode electrode 2. Pixels G11, R12, B13, G14, R15, B16, . . . , R1(*m*−1), B1*m* are formed on the first row. Pixels G21, R22, B23, R2(*m*−1), B2*m* are formed on the next row. Pixels G*n*1, R*n*2, B*n*3, . . . , Rn(*m*−1), Bnm are formed on the last row.

As described above, pixels G11 to Gnm formed on anode electrodes 8 and 9 are formed in a matrix pattern. The pixels are selectively driven by scan-driving the anode lead-out electrodes A1 and A2 and the gate lead-out electrodes GT1 to GT*n*.

FIG. 10 is a block circuit diagram illustrating the drive circuit which performs the above-mentioned drive control. FIG. 11 shows the timing diagram of the drive circuit shown in FIG. 10. FIG. 12 shows various patterns of glowed pixels. With reference to these figures, the drive control will be explained below.

Referring to FIG. 10, numeral 50 represents a field emission type image display panel including field emission cathodes in an n×m pixel matrix pattern. Numeral 51 represents a clock generator that generates a chain of pulses synchronous with applied synchronous signals. Numeral 52 represents a display timing control circuit that controls the display timing using pulses from the clock generator 51. Numeral 53 represents a memory write control circuit that controls writing of input image data to the video memory 54. Numeral 54 represents a video memory formed of a frame memory that stores R, G, and B image data or line memories 54-1, 54-2 and 54-3 that stores R, G, and B image data. Numerals 55-1, 55-2, and 55-3 represent buffer registers that holds R, G, and B image data read out of the video memory 54, respectively.

Moreover, numeral 56 represents an address counter that produces an address of the video memory 54. Numeral 57 represents a color selecting circuit that selects any one of R, G, and B image data. Numeral 58 represents a shift register that shifts data which controls the gate electrodes 3. Numeral 59 represents a latch circuit that latches data from the shift register 59. Numeral 60 represents a gate driver that drives the gate electrode 3 using data of the latch circuit 59. Numeral 61 represents a shift register that shifts image data supplied from the buffer registers 55-1 to 55-3 using the shift clock pulses. Numeral 62 represents a latch circuit that latches data from the shift register 61. Numeral 63 represents a cathode driver that supplies image data of the latch circuit 62 to the cathode electrodes. Numeral 64 represents an anode driver that drives the anode lead-out electrodes A1 and A2.

In FIG. 11, the timing (a) shows an output pulse of the anode driver 64 that drives the anode lead-out electrode A1. The timing (b) shows an output pulse from the anode driver 64 to drive the anode lead-out electrode A2. The timing (c) shows an output pulse from the gate driver 60 to drive the gate lead-out electrode GT1. The timing (d) shows an output pulse from the gate driver 60 to drive the gate lead-out electrode GT3. The timing (e) shows an output pulse from the gate driver 60 to drive the gate lead-out electrode GT5. The timing (f) shows an output pulse from the gate driver 60 to drive the gate lead-out electrode GT*n*+1. The timing (g) shows an output pulse from the gate driver 60 to drive the gate lead-out electrode GT2. The timing (h) shows an output pulse from the gate driver 60 to drive the gate lead-out electrode GT4. The timing (i) shows an output pulse from the gate driver 60 to drive the gate lead-out electrode GT6. The timing (j) shows an output pulse from the gate driver 60 to drive the gate lead-out electrode GT*n*.

Furthermore, the timing (k) shows image data from the cathode driver 63 to be applied to the cathode lead-out electrode C1. The timing (l) shows image data from the cathode driver 63 to apply the cathode lead-out electrode C2. The timing (m) shows image data from the cathode driver 63 to be applied to the cathode lead-out electrode C3. The timing (n) shows image data from the cathode driver 63 to be applied to the cathode lead-out electrode C4. The timing (p) shows a latch pulse at the latch timing of the latch circuit 59 and a latch pulse at the latch timing of the latch circuit 62. The timing (q) represents shift clock pulses supplied to shift register 61. The timing (r) represents image data supplied from the buffer registers 55-1, 55-2, and 55-3 to the shift register 61 in a display order.

Next, the operation of the drive circuit shown in FIG. 11 will be explained below by referring to the timing diagram shown in FIG. 11.

The memory write control circuit 53 controls the write timing of image data. The video memory 54 stores image data for each color, synchronous with clock pulses generated from the clock generator 51. In the video memory 54, the memory 54-1 stores R image data; the memory 54-2 stores G image data; and the memory 54-3 stores B image data. The R image data is read out under control of the color selection circuit 57 and according to an address of the address counter 56, and then is stored into the buffer register 55-1. The G image data is read out under control of the color selection circuit 57 and according to an address of the address counter 56, and then is stored into the buffer register 55-2. The B image data is read out under control of the color selection circuit 57 and according to an address of the address counter 56, and then is stored into the buffer register 55-3.

The color selecting circuit 57 controls the output timing of the buffer registers 55-1, 55-2, and 55-3 and supplies G, R, and B image data to the shift register circuit 61 in the display order shown in FIG. 9. The shift register 61 shifts the image data according to the shift clock pulse S-CLK in the timing (q) shown in FIG. 11.

When G, R, and B image data for two lines, each line corresponding to R, G and B image data for half of the patch-like gate electrodes 3 or pixels associated with each line, are shifted to the shift register 61, the latch circuit 62 latches the color data in response to the latch pulses at the timing (p) shown in FIG. 11. Then the output data from the latch circuit 62 are output to the cathode driver 63.

On the other hand, the display timing control circuit 52 controls the anode driver 64 to apply a positive anode voltage only to the anode lead-out electrode A1 at the timing (a) and (b) shown in FIG. 11.

Moreover, the display timing control circuit 52 supplies the latch pulses (shown with the timing (p) in FIG. 11) as shift pulses to the shift register 58 and shifts the scan signals from the control circuit 52. The latch circuit 59 latches the shift pulse from the shift register 58 every other pulses, in response to the latch pulses. The latch circuit 59 outputs the scan signals shifted every other latch pulse and then outputs them to the gate driver 60.

As a result, in the gate lead-out electrodes GT1 to GT*n*+1 of the image display panel 50, the gate driver 60 supplies gate drive voltages to the gate lead-out electrodes GT1, GT3, GT5, . . . , GT*n*+1 arranged alternately (shown respectively with the timing (c), (d), (e), and (f) in FIG. 11). These gate electrodes GT1, GT3, GT5, . . . , GT*n*+1 are scanned with the timing of the latch pulse.

At this time, as shown by the timing (k), (l), (m) and (n) shown in FIG. 11, the cathode driver 63 supplies image data for two lines to the cathode lead-out electrodes C1, C3, C3, . . . , C*m* in a zigzag pattern, synchronized with the scanning operation of the gate lead-out electrodes GT3, GT5, . . . , GT*n*+1. For example, in the timing (k), (l), (m), and (n) shown in FIG. 11, when the gate lead-out electrode GT*n* is driven, image data corresponding to pixels Gnl and Bn3 of the n-th line and pixels R(*n*−1)2 and G(*n*−1)4 of the (*n*−1)-th line are respectively hsupplied to the cathode lead-out electrodes C1, C2, C3, and C4.

That is, when the gate lead-out electrode GT1 is selectively driven, the pixels G11, B13, . . . odd-numbered of the first line are controllably glowed, as shown in FIG. 12(*a*). In this case, the pixels R12, G14, B16, . . . not driven of the first line are at the ground level (or a negative potential).

In the image display panel 50 shown in FIG. 12(*a*), half of the pixels of the first line are controllably glowed while emitted electrons are focused because of the adjacent gate electrodes 3 at the ground level (or a negative potential), thus reaching the anode electrodes 8.

At this time, with the anode lead-out electrode A1 to which a positive voltage is applied and the anode lead-out electrode A2 at the ground level (or negative potential), electrons more focused can reach the anode electrodes 8.

Furthermore, even when electrons reach adjacent anode electrodes 9, the anode electrodes 9 at the ground level (or a negative potential) can prevent leakage of emitted light.

When the gate lead-out electrode GT3 is selectively driven at the timing of the next latch pulse, image data even-numbered of the second line and image data odd-numbered of the third line are shifted to the shift register 61 in response to the shift clock pulse S-CLK. In the image display panel 50, half of pixels of the second line and half of pixels of the third line can be controllably glowed as shown in FIG. 12(*b*).

When the gate lead-out electrode GT*n*+1 is selectively driven according to the scanning sequence, image data even-numbered of the n-th line are shifted to the shift register 61 in response to the shift clock pulse S-CLK. Thus, as shown in FIG. 12(*c*), half of pixels of the n-th line in the image display panel 50 is controllably glowed. This means that half of pixels for one frame can be controllably glowed.

When the scanning operation reaches the gate lead-out electrode GT*n*+1, the display control timing circuit 52 controls the anode driver 64 to apply a positive anode voltage to the anode lead-out electrode A2 in place of the anode lead-out electrode A1. The display control timing circuit 52 also supplies the latch pulse shown with the timing (p) in FIG. 11 acting as a shift pulse to the shift register 58 so that the scan signals supplied from the control circuit 52 are shifted. Since the latch circuit 59 latches the output signals from the control circuit 52 alternately, the latch circuit 59 outputs a scan signal shifted alternately. The scan signal is applied to the gate driver 60.

In this case, as shown with the timing (g), (h), (i), and (j) in FIG. 11, the gate driver 60 applies gate drive voltages to the gate lead-out electrodes GT2, GT4, GT6, . . . , GT*n* in the image display panel 50. The gate lead-out electrodes GT2, GT4, GT6, . . . , GT*n* are scanned with the timing of the latch pulse.

At this time, the cathode driver 63 supplies image data for two lines to the cathode lead-out electrodes C1, C2, C3, . . . in a zigzag pattern, synchronized with the scanning operation of the gate lead-out electrodes GT2, GT4, GT6, . . . , GT*n*.

Hence, when the gate lead-out electrode GT2 is selectively driven with the timing of a latch pulse, as shown in FIG. 12(*d*), the image data even-numbered of the first line and the image data odd-numbered of the second line are shifted to the shift register 61 in response to the shift clock pulse S-CLK. In the image display panel 50, image pixels even-numbered of the first line and pixels odd-numbered of the second line are controllably glowed.

When the gate lead-out electrode GT*n* is selectively driven at the timing of the last latch pulse in one frame, the image data even-numbered of the (*n*−1)-th and the image data odd-numbered of the n-th line are shifted to the shift register 61 in response to the shift clock pulse S-CLK. In the image display panel 50, pixels even-numbered of the (*n*−1)-th line and pixels odd-numbered of the (*n*+1) line are controllably glowed as shown in FIG. 12(*e*).

The glow control of the remaining pixels for one frame are performed through the above-described scanning operation. At the time the gate lead-out electrode GT*n* of the last row is scanned, the image for one frame is displayed on the image display panel 50.

As described above, since it is sufficient that the number of times that a high voltage is alternately applied to the anode lead-out electrodes is only twice for one frame, the drive circuit for the anode lead-out electrode can be easily constructed.

The patch-like gate electrodes 3 adjacent to the patch-like gate electrodes 3 selectively driven are set to a low level while anode lead-out electrodes not selectively driven are set to a low level, so that emitted electrons can be more focused. This drive circuit can be applied to high-resolution field emission type image display panels.

In the field emission type image display panel of the foregoing embodiment, patch-like gate electrodes are connected to a gate lead-out electrode in a zigzag pattern. However, the patch-like gate electrodes odd-numbered associated with one line (row) can be connected to the gate lead-out electrodes even-numbered.

Moreover, in a similar manner, patch-like anode electrodes can be connected to anode lead-out electrodes in a zigzag pattern.

In the above embodiment, the field emission type image display panel uses three primary color fluorescent materials respectively emitting red, blue, and green. However, plural luminous colors such as red, blue, and green may be displayed using one kind of fluorescent material having wider luminous wavelength range and using filters having different transparent wavelength characteristics. Moreover, a color image may be displayed using two color fluorescent materials.

The fluorescent material may be applied on the electrode of an anode electrode by coating or a fluorescence film may be deposited on the surface of an anode electrode.

In the driving method of the field emission type image display panel according to the present embodiment, since the gate driver 60 drives capacitive loads, a totem pole type driver is preferable for high speed drive operation, in comparison with the open collector type driver.

As described above, according to the field emission type image display panel of the present invention, patch-like anode electrodes and patch-like gate electrodes are used and the patch-like anode electrodes and the patch-like gate electrodes are set to a low level potential. As a result, emitted electrons can be more focused. This feature provides a high-resolution, field emission type display panel that can display images with no blurs.

Since two anode lead-out electrodes can be used, they can be easily derived from both the sides of the anode electrode formed substrate without using three dimensional metallization.

Moreover, anode lead-out electrodes multi-layered with metal films can further improve the electron focusing effect.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A field emission type image display panel, comprising:

plural cathode electrodes formed in a stripe shape on a first substrate and each having emitters for field emission;

cathode lead-out electrodes for supplying signals to said cathode electrodes;

plural patch-like gate electrodes arranged in a matrix form over said plural cathode electrodes and insulated from said plural cathode electrodes;

gate lead-out electrodes which are led out along spaces between two adjacent rows formed of patch-like gate electrodes substantially perpendicular to said cathode electrodes, each of said gate lead-out electrodes being connected to every other one of said patch-like gate electrodes in two adjacent rows in a zigzag arrangement;

a second substrate spaced from said first substrate a predetermined distance apart;

plural patch-like anode electrodes arranged on said second substrate, said plural anode electrodes respectively confronting said plural patch-like gate electrodes in a matrix form;

fluorescent materials formed over said plural patch-like anode electrodes, for displaying an image; and anode lead-out electrodes which are led out along spaces between two adjacent rows of anode electrodes substantially perpendicular to said cathode electrodes, each of said anode lead-out electrodes being connected to anode electrodes in one of said two adjacent rows and to anode electrodes in the other of said two adjacent rows in a zigzag arrangement.

2. The field emission type image display panel as defined in claim 1, wherein each of said plural anode lead-out electrodes comprises a multi-layered structure of metal films.

3. A driving method of a field emission type image display panel which includes plural cathode electrodes formed in a stripe shape on a first substrate and each having emitters for field emission; cathode lead-out electrodes for supplying signals to said cathode electrodes; plural patch-like gate electrodes arranged in a matrix form over said plural cathode electrodes and insulated from said plural cathode electrodes; gate lead-out electrodes which are led out in rows along spaces between two adjacent rows formed of patch-like gate electrodes substantially perpendicular to said cathode electrodes, each of said gate lead-out electrodes being connected to every other one of said patch-like gate electrodes in two adjacent rows in a zigzag arrangement; a second substrate spaced from said first substrate a predetermined distance apart; plural patch-like anode electrodes arranged on said second substrate, said plural anode electrodes respectively confronting said plural patch-like gate electrodes in a matrix form; fluorescent materials formed over said plural patch-like anode electrodes, for displaying an image; and anode lead-out electrodes which are led out along spaces between two adjacent rows of anode electrodes substantially perpendicular to said cathode electrodes, each of said anode lead-out electrodes being connected to anode electrodes in one of said two adjacent rows and to anode electrodes in the other of said two adjacent rows in a zigzag arrangement, said method comprising the steps of:

selectively driving every other electrode of said gate lead-out electrodes;

setting a gate lead-out electrode not selectively driven to a low level potential such that patch-like gate electrodes adjacent to and on both sides of a patch-like gate electrode selectively driven are set to a low level potential; and setting a patch-like anode electrode which confronts said patch-like gate electrode not selectively driven to a low level potential;

wherein electrons emitted from said emitter are focused.

4. The method of driving a field emission type image display panel as defined in claim 3, further comprising the step of setting both said patch-like gate electrode not selectively driven and said patch-like anode electrode to a negative potential level.

5. The field emission type image display panel as defined in claim 1, wherein each of said anode lead-out electrodes is connected to odd-ordered anode electrodes in one of said two adjacent rows and to even-ordered anode electrodes in the other of said two adjacent rows in said zigzag arrangement.

6. The method of driving a field emission type image display panel as defined in claim 3, comprising:

setting an anode lead-out electrode being connected to odd-ordered anode electrodes in one of said two adjacent rows and to even-numbered anode electrodes in the other of said two adjacent rows in said zigzag arrangement to a desired voltage level.

7. A method of driving a field emission type image display panel, comprising:

driving alternate ones of gate lead-out electrodes, said gate lead-out electrodes each connected to patch-like gate electrodes in two adjacent rows of gate electrodes in a zig-zag arrangement; and driving an anode lead-out electrode connected to patch-like anode electrodes in two adjacent rows of anode electrodes disposed in a corresponding relation to said gate electrodes in said two adjacent rows of gate electrodes in a zig-zag arrangement.

8. The method of driving a field emission type image display panel as defined in claim 7, comprising:

setting a gate lead-out electrode not selectively driven to a low level potential such that gate electrodes adjacent to and on both sides of a gate electrode selectively driven are set to a low level potential in said two adjacent rows of gate electrodes; and setting an anode lead-out electrode not selectively driven to a low level potential such that anode electrodes adjacent to and on both sides of an anode electrode selectively driven are set to a low level potential in said two adjacent rows of anode electrodes.

9. The method of driving a field emission type image display panel as defined in claim 7, wherein said driving step comprises:

setting an anode lead-out electrode being connected to odd-ordered anode electrodes in one of said two adjacent rows and to even-numbered anode electrodes in the other of said two adjacent rows in a zigzag arrangement to a desired voltage level.

* * * * *